US010328317B2

(12) United States Patent
Wang et al.

(10) Patent No.: US 10,328,317 B2
(45) **Date of Patent: *Jun. 25, 2019**

(54) GOLF CLUBS WITH ADJUSTABLE LOFT AND LIE AND METHODS OF MANUFACTURING GOLF CLUBS WITH ADJUSTABLE LOFT AND LIE

(71) Applicant: KARSTEN MANUFACTURING CORPORATION, Phoenix, AZ (US)

(72) Inventors: Calvin Wang, Phoenix, AZ (US); Xiaojian Chen, Phoenix, AZ (US); Erik Henrikson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/909,489

(22) Filed: Mar. 1, 2018

(65) Prior Publication Data

US 2018/0185712 A1 Jul. 5, 2018

Related U.S. Application Data

(63) Continuation of application No. 15/494,790, filed on Apr. 24, 2017, now Pat. No. 9,937,387, which is a (Continued)

(51) Int. Cl.
*A63B 53/02* (2015.01)
*A63B 53/04* (2015.01)
(Continued)

(52) U.S. Cl.
CPC ..... *A63B 53/02* (2013.01); *A63B 53/0487* (2013.01); *A63B 53/065* (2013.01);
(Continued)

(58) Field of Classification Search
CPC ..... A63B 53/02; A63B 2053/021; A63B 2053/022; A63B 2053/023;
(Continued)

(56) References Cited

U.S. PATENT DOCUMENTS 648,256 A 4/1900 Hartley
2,146,321 A 2/1939 Wettlaufer
(Continued)

OTHER PUBLICATIONS

International Search Report and Written Opinion of the International Searching Authority from PCT Application No. PCT/US2013/077796, dated Apr. 25, 2014.
(Continued)

*Primary Examiner* — Sebastiano Passaniti

(57) ABSTRACT

Embodiments of golf clubs with adjustable loft and lie and methods of manufacturing golf clubs with adjustable loft and lie are generally described herein. The invention relates in particular to a golf club head with an adjustment portion that allows a user to change the loft and lie. The separate adjustment portions of the club head can couple the upper hosel to the body at a plurality of positions. An insert part of the adjustment portion has an upper section for receiving the upper hosel portion, a middle section, and a lower hosel portion. The sections of the adjustment portion can be coupled together by a fastener so that the sections are rotationally moveable.

18 Claims, 11 Drawing Sheets

Related U.S. Application Data continuation of application No. 14/705,841, filed on May 6, 2015, now Pat. No. 9,675,854.

(60) Provisional application No. 62/072,763, filed on Oct. 30, 2014, provisional application No. 61/990,999, filed on May 9, 2014.

(51) Int. Cl.
*A63B 53/06* (2015.01)
*A63B 60/42* (2015.01)
*A63B 71/06* (2006.01)

(52) U.S. Cl.
CPC ..... *A63B 60/42* (2015.10); *A63B 71/06* (2013.01); *A63B 2053/023* (2013.01); *A63B 2053/025* (2013.01); *A63B 2053/026* (2013.01); *A63B 2071/0694* (2013.01); *Y10T 29/49002* (2015.01)

(58) Field of Classification Search
CPC ..... A63B 2053/025; A63B 2053/026; A63B 2053/027; A63B 2053/028; A63B 53/065; A63B 53/0487; A63B 2071/0694
USPC ..... 473/244–248, 305–315
See application file for complete search history.

(56) References Cited

U.S. PATENT DOCUMENTS 2,155,830 A 4/1939 Howard
2,217,338 A 10/1940 Fuller
3,170,691 A 2/1965 Pritchard
3,430,957 A 3/1969 Ernest
3,840,231 A * 10/1974 Moore ..... A63B 53/06 473/245
3,931,969 A 1/1976 Townhill
4,073,492 A 2/1978 Taylor
4,736,951 A 4/1988 Grant
4,909,515 A 3/1990 Redkey
4,943,059 A * 7/1990 Morell ..... A63B 53/02 473/306
5,263,711 A 11/1993 Addis
5,390,918 A 2/1995 Meyers et al.
5,542,666 A 8/1996 Chou
5,580,051 A 12/1996 Fisher
5,597,362 A 1/1997 Lee
5,634,857 A 6/1997 Bradshaw
5,851,155 A 12/1998 Wood
6,095,929 A * 8/2000 Clark ..... A63B 60/00 473/248
6,213,889 B1 4/2001 Hamburger
6,273,828 B1 8/2001 Wood
6,287,215 B1 9/2001 Fisher
6,769,994 B2 8/2004 Boone
7,291,073 B2 11/2007 Park
7,326,126 B2 2/2008 Holt et al.
7,789,766 B2 9/2010 Morris
7,878,921 B2 2/2011 Bennett
8,075,417 B2 12/2011 Thomas
8,083,608 B2 12/2011 Thomas
8,088,019 B1 1/2012 Long et al.
8,133,130 B2 * 3/2012 Morris ..... A63B 53/02 473/288
8,172,695 B2 5/2012 Cameron
8,182,358 B2 5/2012 Sander et al.
8,262,499 B2 9/2012 Murphy
8,480,511 B2 7/2013 Sargent et al.
8,535,173 B2 * 9/2013 Golden ..... A63B 53/0466 473/307
8,545,344 B2 * 10/2013 De La Cruz ..... A63B 53/02 473/288
8,574,093 B2 11/2013 Sato
8,585,511 B2 11/2013 Sato
8,684,859 B1 4/2014 Aguinaldo
8,801,537 B1 8/2014 Seluga et al.
9,050,508 B2 6/2015 Kitagawa
9,308,430 B2 4/2016 Nivanh
9,675,854 B2 6/2017 Wang
9,764,203 B2 * 9/2017 Bennett ..... A63B 53/02
9,937,387 B2 * 4/2018 Wang ..... A63B 53/065
2011/0111878 A1 * 5/2011 Vald'Via ..... A63B 53/02 473/282
2011/0111881 A1 5/2011 Sander et al.
2011/0118045 A1 5/2011 Sato
2011/0177876 A1 * 7/2011 Bennett ..... A63B 53/02 473/307
2011/0275449 A1 11/2011 Hocknell et al.
2012/0225729 A1 * 9/2012 Burch ..... A63B 60/00 473/307
2012/0258818 A1 10/2012 Beach et al.
2013/0196784 A1 8/2013 Clausen
2013/0288816 A1 10/2013 Nakamura
2014/0080617 A1 3/2014 Llewellyn et al.
2014/0187344 A1 7/2014 Jones et al.
2014/0349778 A1 11/2014 Knutson et al.

OTHER PUBLICATIONS

International Search Report and Written Opinion of the International Searching Authority from PCT Application No. PCT/US2015/029512, dated Mar. 7, 2017.

* cited by examiner

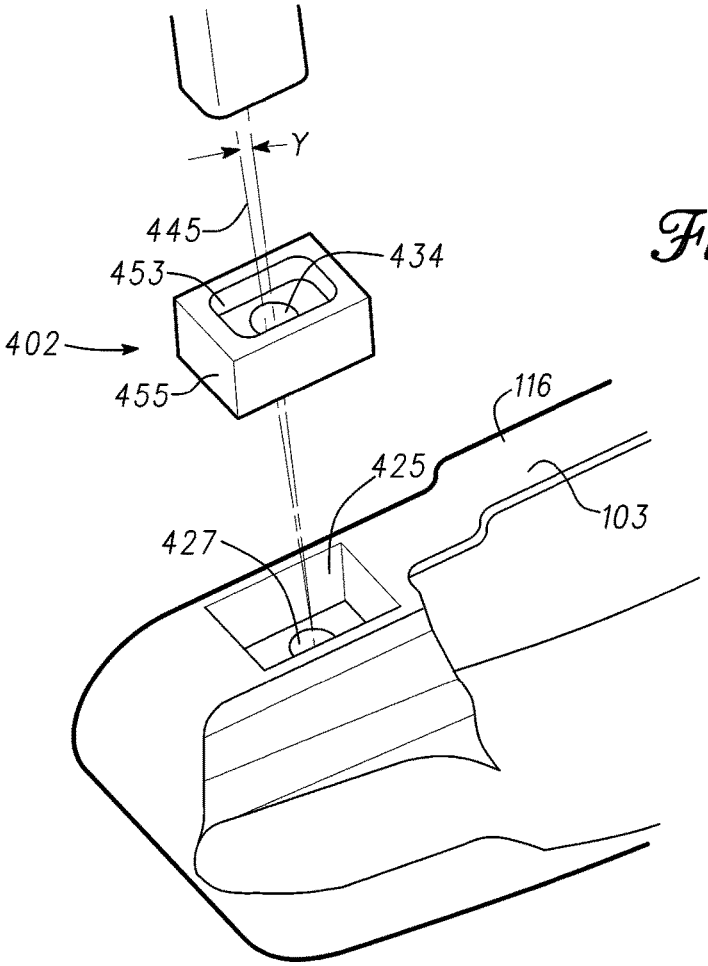
Fig. 24
Fig. 25
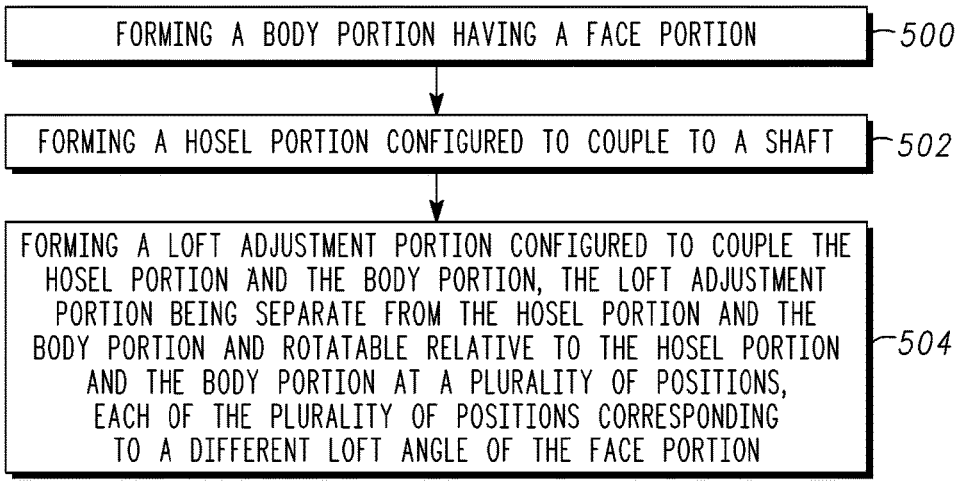

GOLF CLUBS WITH ADJUSTABLE LOFT AND LIE AND METHODS OF MANUFACTURING GOLF CLUBS WITH ADJUSTABLE LOFT AND LIE

CROSS REFERENCE TO RELATED APPLICATION

This is a continuation of U.S. patent application Ser. No. 15/494,790, filed on Apr. 24, 2017, which is a continuation of U.S. patent application Ser. No. 14/705,841, filed on May 6, 2015, which claims the benefit of U.S. Provisional Patent Application No. 61/990,999, filed on May 9, 2014, and U.S. Provisional Patent Application No. 62/072,763, filed on Oct. 30, 2014, the contents of all disclosures above are incorporated fully by reference herein.

FIELD

The present application generally relates to golf clubs, and more particularly, to golf clubs with adjustable loft and lie and methods of manufacturing golf clubs with adjustable loft and lie.

BACKGROUND

Golf clubs may be fitted to an individual based on the type of golf club, the individual's physical characteristics and/or the individual's play style. Depending on the individual's physical characteristics and play style, a golf club having a certain lie angle and loft angle may be selected to provide optimum performance for the individual. Accordingly, each individual may require a golf club having a certain lie and loft to fit the physical characteristics and the play style of the individual.

BRIEF DESCRIPTION OF THE DRAWINGS

FIG. 24 shows an exploded perspective view of the loft angle adjustment mechanism of FIG. 18 used as a lie angle adjust mechanism according to one embodiment.

FIG. 25 shows a flowchart the method of manufacturing a golf club head having a loft angle adjustment mechanism according to one embodiment.

DESCRIPTION

Figure 1:
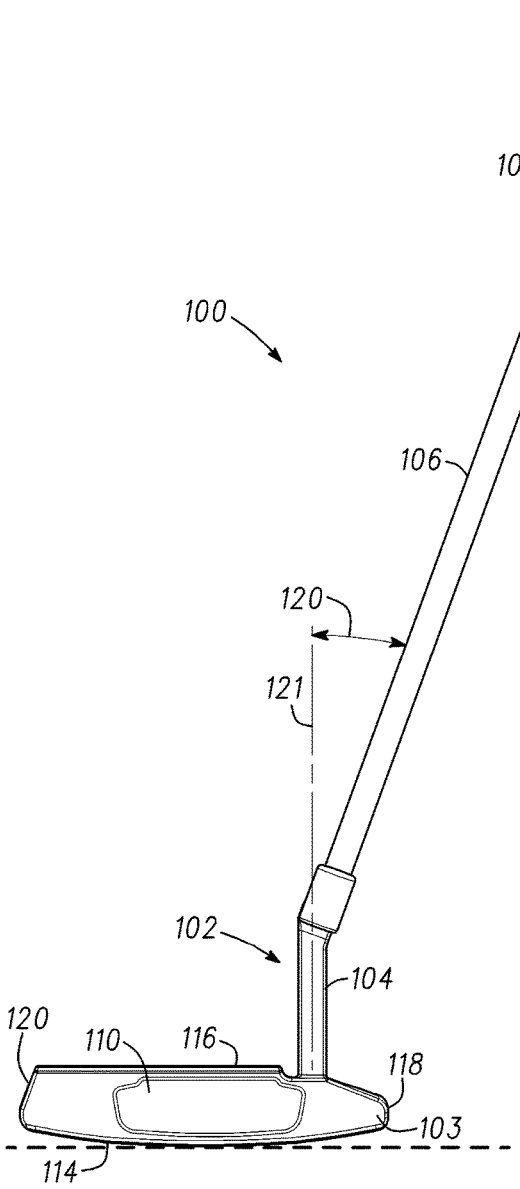
FIG. 1 shows an exemplary golf club.
Figure 2:
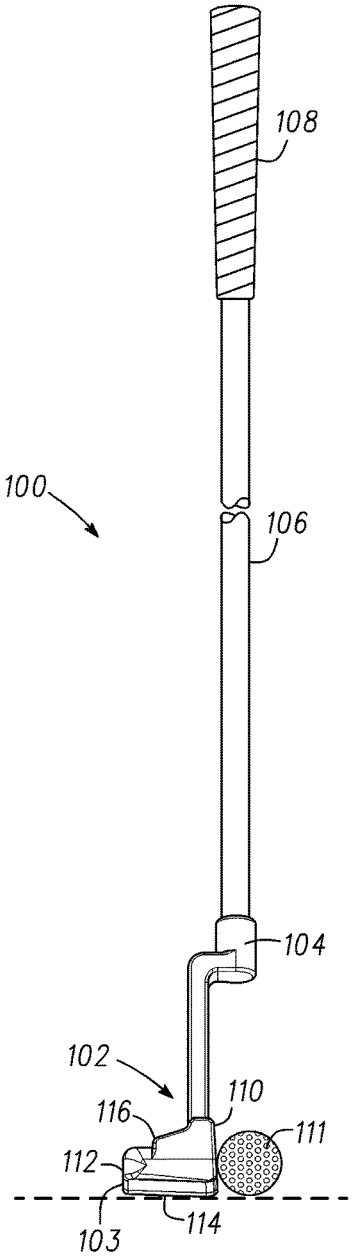
FIG. 2 shows an exemplary golf club.
Figure 3:
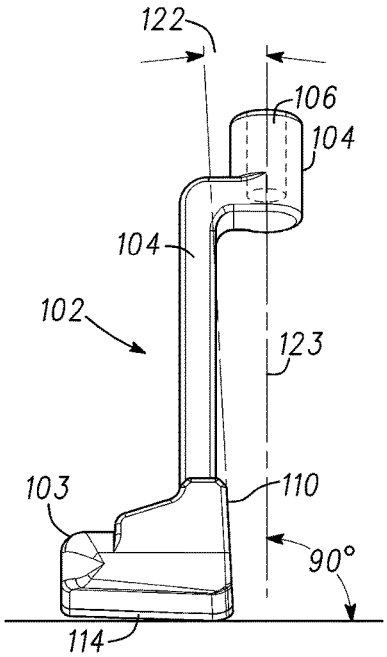
FIG. 3 shows an exemplary golf club.

Referring to FIGS. 1-3, a golf club 100 is shown. The golf club 100 includes a club head 102 that is coupled to a shaft 106. The club head 102 may be connected directly to the shaft 106. In the examples of FIGS. 1-3, the club head includes a hosel 104, which connects a body portion 103 of the club head 102 to the shaft 106. The hosel 104 may be a one-piece part with the body portion 103 or may include a single part or multiple parts that are connected to the body portion 103. The shaft 106 is connected to the hosel 104. The shaft 106 may include a grip 108 by which an individual can hold and use the golf club 100 to strike a golf ball with a face portion 110 of the body portion 103. The golf club head 100 may be a wood-type golf club, such as a driver-type golf club head, a fairway wood-type golf club head (e.g., 2-wood golf club, 3-wood golf club, 4-wood golf club, 5-wood golf club, 6-wood golf club, 7-wood golf club, 8-wood golf club, or 9-wood golf club), a hybrid-type golf club head or any other suitable type of golf club head with a hollow body or a body with one or more cavities, apertures, recesses or channels. Although the disclosure may refer to a certain type of club, the apparatus, articles of manufacture, and methods described herein may be applicable to other suitable types of golf club heads.

The face portion 110 provides a surface for striking a golf ball 111 (shown in FIG. 2). The body portion 103 includes a back portion 112 formed opposite to the face portion 110 with a sole portion 114 being defined between the back portion 112 and the face portion 110. A top rail portion 116 may be formed opposite to the sole portion 114 whereas the face portion 110 is defined by a heel portion 118 formed adjacent the hosel 104 and a toe portion 120 defined at the far end of the face portion 110 and opposite to the heel portion 118. Although the golf club head 102 may conform to rules and/or standards of golf defined by various golf standard organizations, governing bodies, and/or rule establishing entities, the apparatus, articles of manufacture, and methods described herein are not limited in this regard.

Referring to FIG. 1, a lie angle 120 of the golf club 100 may be defined by the angle between the shaft 106 and the vertical, which is represented in FIG. 1 with the vertical line 121, when the body portion 103 is generally horizontally oriented. Referring to FIG. 3, a loft angle 122 may be defined as the angle between the face portion 110 and the club shaft 106 when the center line 123 of the club shaft 106 is generally vertical, i.e., forms a generally 90° angle with the ground.

Figure 4:
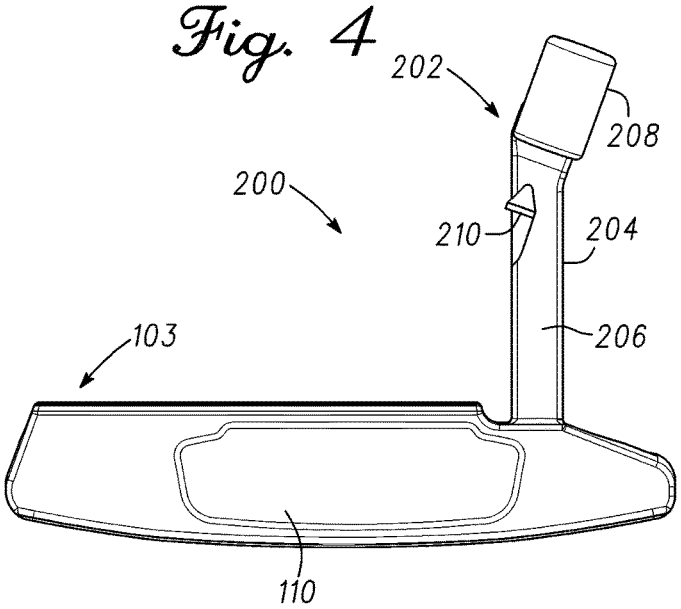
FIG. 4 shows a front view of a golf club head having a loft angle adjustment mechanism according to one embodiment.
Figure 5:
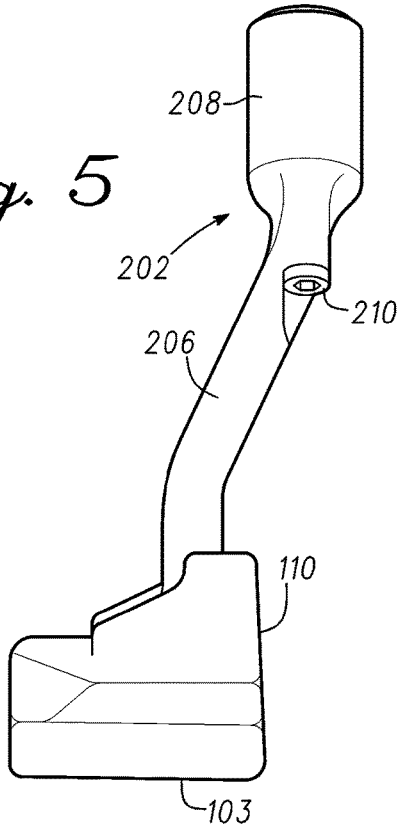
FIGS. 5 and 6 show opposite side views of the golf club head of FIG. 4.
Figure 6:
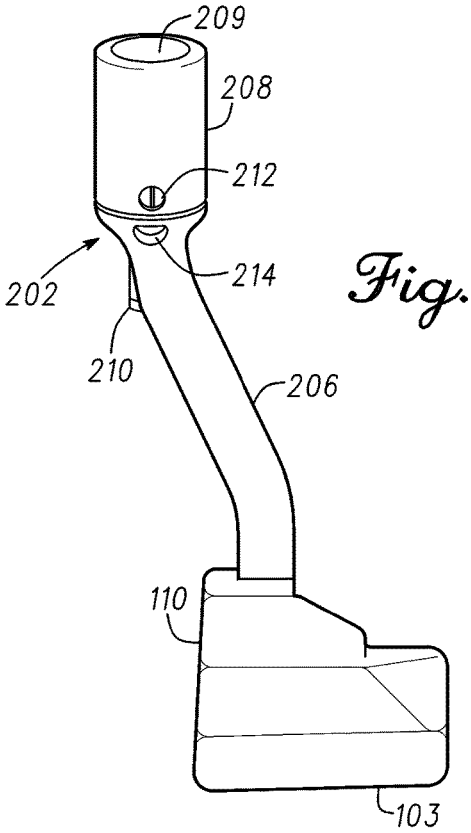

Referring to FIGS. 4-6, a golf club head 200 having an adjustable loft angle mechanism 202 according to one example is shown. The golf club head 200 may be similar in many respects to the golf club head 102. Accordingly, same parts may be referred to with the same reference numbers and the detailed description of the golf club head 200 is not provided for brevity. The golf club head 200 includes a body portion 103 and a hosel 204 that is configured to connect to a shaft (not shown). The hosel 204 may include a lower hosel portion 206 and an upper hosel portion 208. The lower hosel portion 206 is attached to the body portion 103 and extends upward from the body portion 103. The upper hosel portion 208 is coupled to the lower hosel portion 206 and is configured to receive a shaft (not shown). Alternatively, the golf club head 200 may include a one-piece hosel 204 that is either rotationally coupled to either the body portion 103 or the shaft (not shown) to provide loft angel adjustment of the face portion 110 as described herein.

In the examples of FIGS. 4-6, the upper hosel portion 208 is generally cylindrical to include a cylindrical hole 209 for receiving a shaft (not shown). The lower hosel portion 206 and the upper hosel portion 208 are coupled as described in detail herein by a first fastener 210 and a second fastener 212 (shown in FIG. 6). The fasteners 210 and 212 may be pins, screws or bolts. Decoupling the lower hosel portion 206 from the upper hosel portion 208 by removing or disengaging the fasteners 210 and 212 allows an individual to adjust the loft angle of the face portion 110. The loft angle of the face portion 110 may be shown through a window 214 (shown in FIGS. 6, 10 and 17) provided on the lower hosel portion 206.

Figure 7:
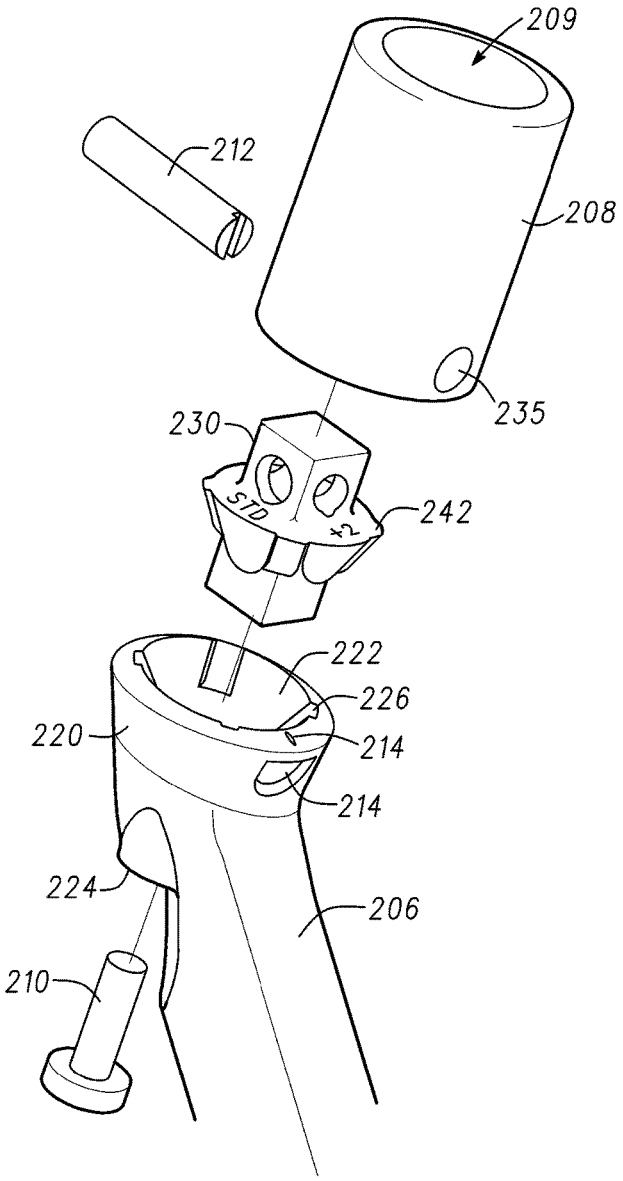
FIG. 7 shows a perspective exploded view of the loft angle adjustment mechanism of the golf club head of FIG. 4.

Referring to FIG. 7, the first hosel portion 206 includes an end portion 220 having an insert receptacle 222 and a bore 224 extending through the bottom of the insert receptacle 222. The interior of the insert receptacle 222 may include a plurality of grooves 226. Each groove 226 may extend from near the top or at the top of the insert receptacle 222 toward the bore 224. In the example of FIG. 7, each of the grooves 226 is radially spaced relative to an adjacent groove 226 by about 90°. Therefore, the insert receptacle 222 of the example of FIG. 7 includes four grooves 226. The insert receptacle 222 is shaped to receive a correspondingly shaped insert 230.

Figure 8:
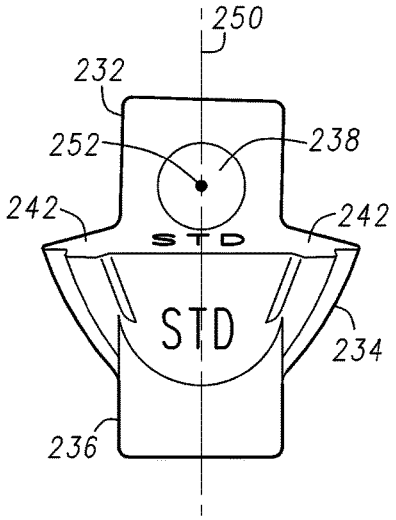
FIGS. 8 and 9 show to side views of an insert for the loft angle adjustment insert of the golf club head of FIG. 4.
Figure 9:
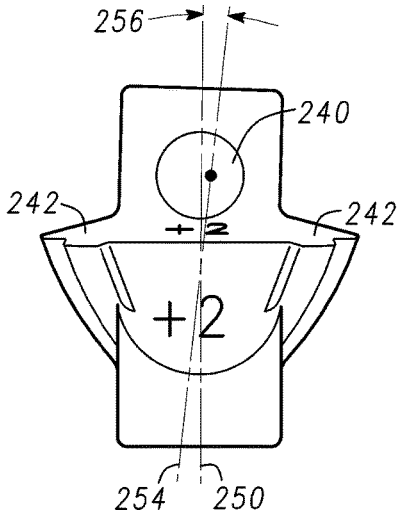
Figure 10:
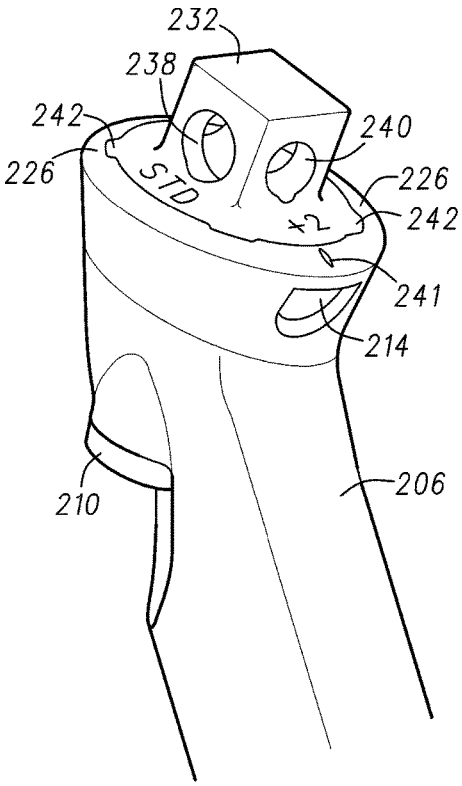
FIG. 10 shows a perspective view of a section of the loft angle adjustment mechanism of the golf club head of FIG. 4.

Referring to FIGS. 8-10, the insert 230 is shown in more detail. The insert 230 includes an upper section 232, a middle section 234 and a lower section 236. The upper section 232 may be cube shaped and include a first bore 238 extending through a first pair of opposing side walls of the upper section 232 and a second bore 240 extending through a second pair of the opposing side walls of the upper section 232. Therefore, the first bore 238 and the second bore 240 may be generally perpendicular. The first bore 238 and the second bore 240 are configured to receive the second fastener 212.

The middle section 234 has a shape corresponding to the shape of the insert receptacle 222 and is configured to be received in the insert receptacle 222. In the examples of FIGS. 7-10, the insert receptacle 222 is generally cup shaped and the middle section 234 of the insert 230 has a shape corresponding to the interior volume of the insert receptacle 222. As shown in FIG. 10, the middle section 234 can fit inside the insert receptacle 222. Referring to FIGS. 8 and 9, the middle section 234 includes four axial projections 242. Each axial projection has a shape corresponding to the shape of the grooves 226 and is configured to be received in any one of the grooves 226. Accordingly, each projection 242 is radially spaced from an adjacent projection 242 by about 90°. The middle section 234 can fit inside the insert receptacle 222 when each projection 242 is received inside a groove 226. As described above, in the examples of FIGS. 7-10, the insert receptacle 222 includes four grooves 226 that are radially spaced by about 90°. Accordingly, the insert 230 can be positioned inside the insert receptacle 222 at four relative radial positions (hereinafter referred to as "the four positions" of the insert 230) of about 0°, 90°, 180° and 270°. To reposition the insert 230 inside the insert receptacle 222, the insert 230 can be removed from the insert receptacle 222, rotated to one of the four noted radial positions, and inserted back into the insert receptacle 222 so that each projection 242 is received inside a groove 226. To secure the insert 230 inside the insert receptacle 222, the first fastener 210, which may be threaded, may be inserted through the bore 239 at the bottom of the insert receptacle 222 to engage a correspondingly threaded bore in the lower section 236 of the insert 230. Thus, tightening the first fastener 210 secures the insert 230 inside the insert receptacle 222 as shown by the example of FIG. 10.

Referring to FIG. 7, after the insert 230 is placed in the insert receptacle 222 as described herein, the second hosel portion 208 is mounted over the insert 230 such that a hole 235 of the second hosel portion 208 is vertically aligned with the window 214. To allow an individual to align the hole 235 with the window 214, the rim of the insert receptacle 222 may include position marker 241 that indicates the position of the window 214. After the second hosel portion 208 is mounted over the insert 230, one of the bores 238 or 240 of the insert 230 can become coaxially aligned with the hole 235 depending on the position of the insert 230 inside the insert receptacle 222. Thus, the hole 235, the bore 238 or 240 and the window 214 are vertically aligned, with the hole 235 and the bore 238 or 240 being axially aligned. The fastener 212 is then inserted through the hole 235 and through the bore 238 or 240 and tightened to secure the second hosel portion 208 to the insert 230 and to the first hosel portion 206. The fastener 212 may have a threaded end (not shown) that engages the correspondingly threaded hole inside the second hosel portion 208 located opposite to the hole 235.

Figure 11:
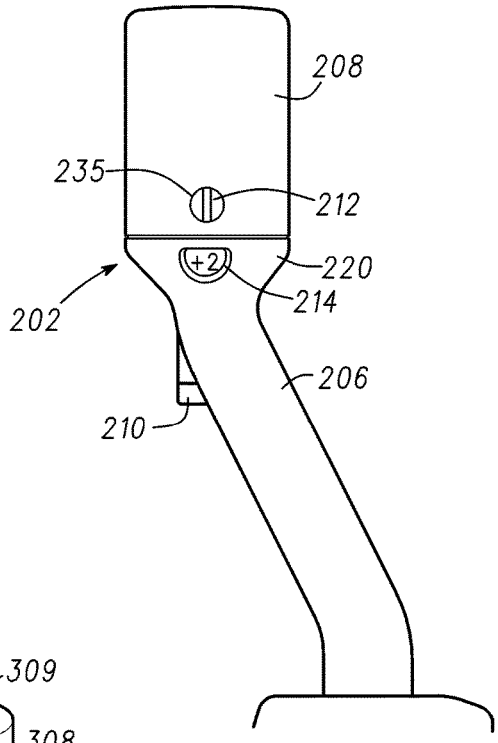
FIG. 11 shows a close-up of the loft angle adjustment mechanism of the golf club head of FIG. 4 showing a loft angle indicator.

The four positions of the insert 230 may correspond to three loft angle settings for the golf club head 200. The loft angle setting for the golf club head 200 may be indicated on the insert 230 by a loft angle indicator, which may be any text, symbol, graphic, etching, depression, projection and/or surface pattern. The three loft angle settings for the golf club head 200 may be a neutral or standard setting, a loft angle setting that is positively offset (e.g., +1°, +2°, or +3°) from the standard setting, and a loft angle setting that is negatively offset (e.g., −1°, −2°, or)−3° from the standard setting. In the examples of FIGS. 7-10, loft angle indicators are shown by alphanumeric characters, which are STD for a neutral or standard loft angle setting, +2° for a loft angle of +2° relative to the standard loft angle setting, and −2° for a loft angle of −2° relative to the standard loft angle setting. The loft angle indicator for each loft angle setting may be positioned on top and on the side of the insert 230. As shown in FIG. 10, the loft angle indicators on top of the insert 230 allow an individual to visually align a preferred loft angle indicator with the position marker 241 on the rim of the insert receptacle when placing the insert 230 in the insert receptacle 222. The loft angle indicator that is aligned with the position marker 241, i.e., the window 214, indicates the position of the insert 230 in the insert receptacle 222 that provides the loft angle setting shown through the window 214. Referring to FIGS. 6 and 11, when the insert 230 is inserted in the insert receptacle 222 so as to fit inside the insert receptacle 222 as described herein, the loft angle indicator corresponding to the loft angle of the golf club head 102 may be visible to an individual from the window 214 of the lower hosel portion 206.

The first of the four positions of the insert 230 may correspond to a standard loft angle of the face 110. Referring to FIG. 8, when the insert 230 is inserted in the insert receptacle 222 such that the loft angle indicator corresponding to a standard loft angle setting, e.g., STD, can be viewed through the window 214, the center axis 250 of the insert 230 and the center axis 252 of the bore 238 intersect. Accordingly, the lower section 236 and the upper section 232 of the insert 230 are vertically aligned or have an angle of about 0° relative to each other. Thus, when the second hosel portion 208 is fastened to the first hosel portion 206 as described above, the loft angle of the face 110 is at a standard loft angle setting.

The second of the four positions of the insert 230 may correspond to a positive loft angle of the face 110. Referring to FIG. 9, when the insert 230 is inserted in the insert receptacle 222 such that the loft angle indicator corresponding to a positive loft angle setting (shown for example in FIGS. 7-10 to be a +2° loft angle setting relative to the standard loft angle setting) can be viewed through the window 214, the center axis 250 of the insert 230 and the center axis 254 of the bore 240 do not intersect. As shown in FIG. 9, the center axis 254 of the bore 240 is offset from the center axis 250 of the insert 230 by an angle 256. The magnitude of the angle 256 may correspond to the relative loft angle setting with respect to the standard loft angle setting. For example as shown in FIGS. 7-10, the angle 256 is about 2°. Accordingly, the lower section 236 and the upper section 232 of the insert 230 are offset at an angle of about 2° relative to each other. Thus, when the second hosel portion 208 is fastened to the first hosel portion 206 as described above, the second hosel portion 208 is offset relative to the lower hosel portion 206 by about +2° relative to the standard loft angle. The second hosel portion 208 receives the shaft (not shown) of the golf club. Therefore, the face 110 has a loft angle of +2° relative to the standard loft angle setting.

The third of the four positions of the insert 230 may correspond to a negative loft angle of the face 110. The insert 230 can be inserted in the insert receptacle 222 such that the loft angle indicator corresponding to a negative loft angle setting (shown for example in FIGS. 7-10 to be a −2° loft angle setting relative to the standard loft angle setting) can be viewed through the window 214. Referring to FIG. 10, the positive and negative loft angle indicators correspond to opposing ends of the bore 240. Accordingly, when the negative loft angle indicator can be seen through the window 214, the side of the bore 240 that is opposite to the one shown in FIG. 9 is on the same side of the insert receptacle 222 as the window 214. Accordingly, the center axis 254 of the bore 240 is offset from the center axis 250 of the insert 230 by a negative of the angle 256. For example, as shown in FIGS. 7-10, the angle 256 is about +2°; hence the negative loft angle setting corresponds to about −2°. In other words, the lower section 236 and the upper section 232 of the insert 230 are offset at an angle of about −2° relative to each other. Thus, when the second hosel portion 208 is fastened to the first hosel portion 206 as described above, the loft angle of the face 110 is at a negative loft angle setting, e.g. about −2°, relative to the standard loft angle setting.

The fourth of the force positions of the insert 230 corresponds to the standard loft angle since rotation of the insert 230 to the fourth position places the opposite side of the bore 238 that is shown in FIG. 8 on the same side as the window 214. Thus, the insert 230 allows adjustment of the loft angle of the face of the golf club between a negative loft angle, a standard loft angle, and a positive loft angle. As discussed above, the insert includes four sides as defined by the axial projections 242 to provide three different loft angle settings. However, the insert could have more or less sides to provide more for less than three different loft angle settings.

In the embodiments of FIGS. 4-11, the hosel 204 includes a first hosel portion 206 and a second hosel portion 208, which are rotatably coupled by the loft adjustment mechanism 202 to provide loft angle adjustment of the face portion 110. The loft adjustment mechanism 202 may be positioned at any location between the shaft (not shown) and the body portion 103, partially in the body portion 103, or fully in the body portion 103. For example, the first hosel portion 206 and the second hosel portion 208 may have generally the same length such that the loft adjustment mechanism 202 is located at approximately half the distance between the body portion 103 and the shaft (not shown). In another example, the loft adjustment mechanism 202 may be located partially or fully in the body portion 103. Accordingly, the hosel 204 may be a one-piece hosel. Furthermore, the body portion 103 may include an insert receptacle (not shown) such as the insert receptacle 222, and a bore (not shown) extending through the bottom of the insert receptacle to receive a fastener to attach an insert 230 in the insert receptacle of the body portion 103 as described in detail herein. The hosel 204 can then be mounted on and attached to the insert 230 as described in detail herein.

Figure 12:
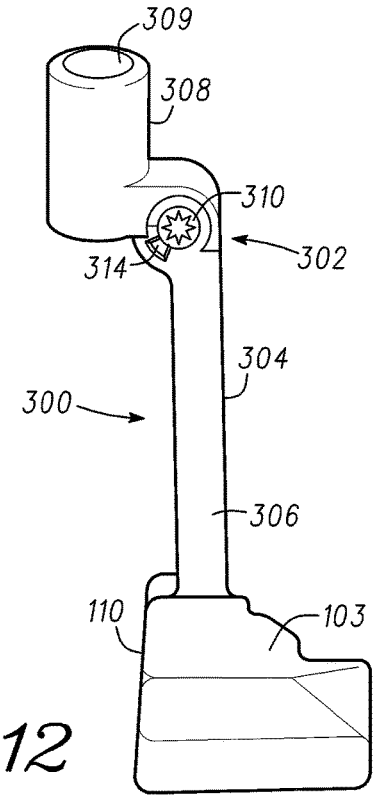
FIG. 12 is a side view of a golf club head having a loft angle adjustment mechanism according to one embodiment.

Referring to FIG. 12, a golf club head 300 having an adjustable loft angle mechanism 302 according to one example is shown. The golf club head 300 may be similar in many respects to the golf club head 102. Accordingly, same parts may be referred to with the same reference numbers and the detailed description of the golf club head 300 is not provided for brevity. The golf club head 300 includes a body portion 103 and a hosel 304 configured to connect to a shaft (not shown). The hosel of 304 includes a lower hosel portion 306 and an upper hosel portion 308. The lower hosel portion 306 is attached to the body portion 103 and extends upward from the body portion 103. The upper hosel portion 308 is coupled to the lower hosel portion 306 and is configured to receive the shaft (not shown). In the examples of FIG. 12, the upper hosel portion 308 is generally cylindrical to include the cylindrical hole 309 for receiving the shaft (not shown). The lower hosel portion 306 and the upper hosel portion 308 are rotationally coupled as described in detail below and can be secured from rotation relative to each other by a fastener 310. The fastener 310 may be a pin, a screw or a bolt. As further described in detail below, decoupling the lower hosel portion 306 from the upper hosel portion 308 by removing or disengaging the fastener 310 allows an individual to adjust the loft angle of the face 110. The loft angle of the face 110 may be shown through a window portion 314 (shown in FIGS. 12-14 and 17) on the lower hosel portion 306.

Figure 14:
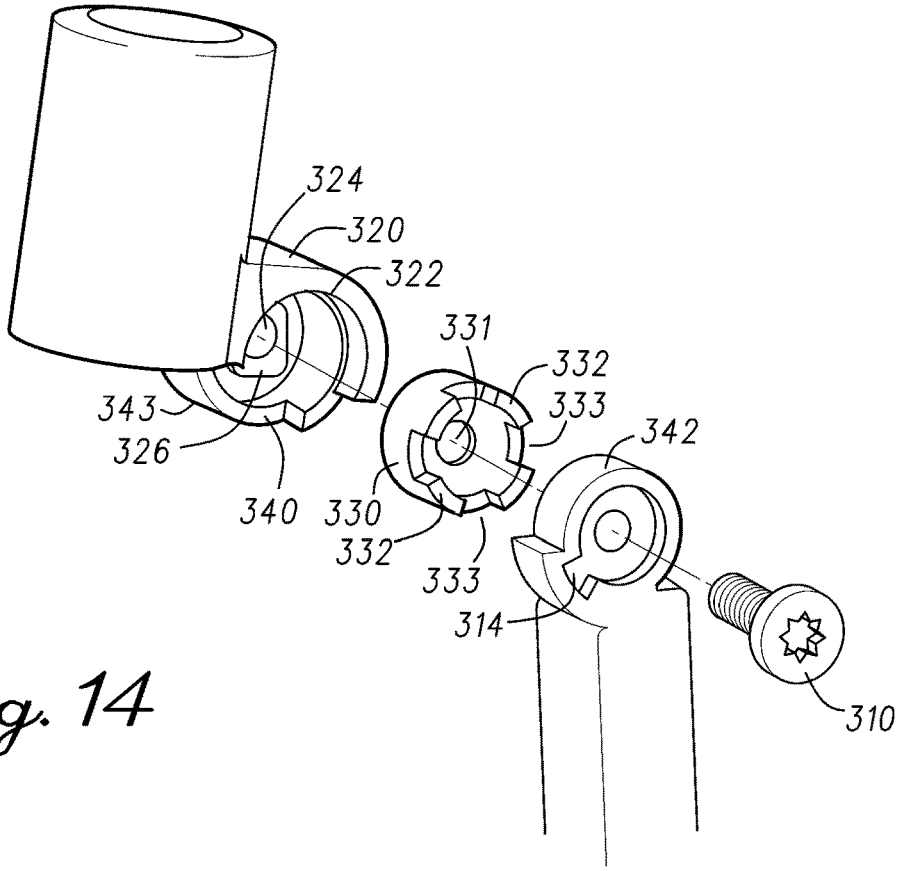
FIG. 14 shows a perspective exploded view of the loft angle adjustment mechanism of the golf club head of FIG. 12.

Referring to FIG. 14, the second hosel portion 308 includes an end portion 320 having an insert receptacle 322 and a bore 324 extending through the bottom of the insert receptacle 322. The interior of the insert receptacle 322 may be generally cylindrical and include a square projection 326 around the bore 324. The insert receptacle 322 is configured to receive a correspondingly shaped insert 330, which is shown in detail in FIGS. 14-16. The insert 330 may be generally cylindrical. The insert 330 includes four radially spaced apart arms 332 that extend outwardly from the outer side of the insert 330. The arms 332 define radial gaps 333 between the arms 332. The inner side of the insert 330 (i.e., the side that is opposite to the arms 332) is hollow and includes a square indentation 327 (shown in FIG. 15) configured to receive the square projection 326 of the insert receptacle 322. Accordingly, when the square indentation 327 is placed over the square projection 326, the insert 330 cannot rotate in the insert receptacle 322. Additionally, the insert 330 can be placed in the insert receptacle 322 at four positions that are about 90° relative to each other due to the reception of the square projection 326 inside the square indentation 327. The insert 330 also includes a hole 331 for receiving the fastener 310.

Figure 15:
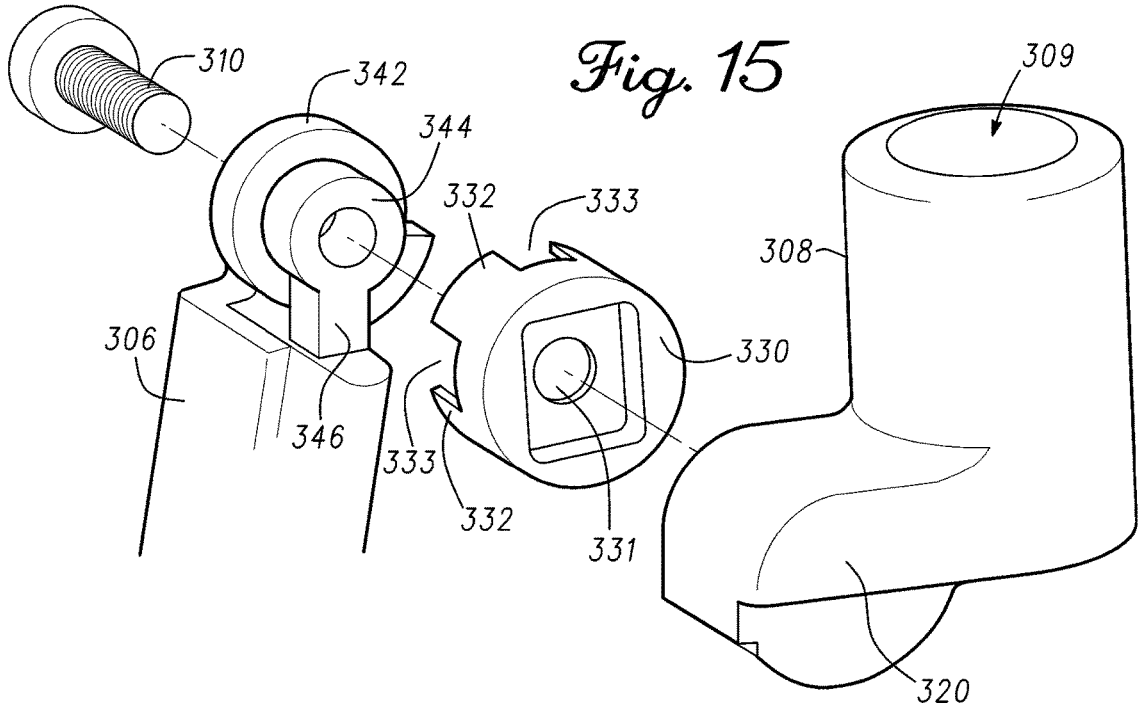
FIG. 15 shows another perspective exploded view of the loft angle adjustment mechanism of the golf club head of FIG. 12.

The insert receptacle 322 includes a cutout portion 340. When the insert 330 is placed in the insert receptacle 322 such that the square projection 326 is received in the square indentation 327, one of the gaps 333 of the insert 330 may be aligned with the cutout portion 340. Referring to FIG. 15, the lower hosel portion 306 includes an end portion 342 having the generally circular projection 344 (shown in FIG. 15) that is configured to be received in the insert 330 such that the projection is surrounded by the arms 332. The end portion 342 includes a bridge portion 346 that extends from the projection 344 to the lower hosel portion 306. When the projection 344 is received in the insert 330 as described herein, the bridge portion 346 is received in the cutout 340 and one of the gaps 333 of the insert that is aligned with the cutout 340. Referring to FIG. 14, the end portion 342 of the lower hosel portion 306 includes the window portion 348 through which the top portion of one of the arms 332 that is adjacent to one of the gaps 333 that is aligned with the cutout 340 is visible. To position one of the arms 332 so it is visible through the window portion 348, a rim portion of the insert receptacle 322 includes a position marker 343 (shown in FIG. 14). When the insert 330 is inserted in the insert receptacle 322, the top of the arm 332 that is aligned with the position marker 343 can be viewed through the window portion 348. When the insert 330 is received in the insert receptacle 322 as described herein and shown in FIG. 16, and the projection 344 of the end portion 342 is received in the insert 330, the fastener 310 may be inserted through the end portion 342, through the hole 331 of the insert 330 and through the hole 324 of the insert receptacle 322 and tightened to fasten these components together. The bore 324 of the insert receptacle 322 may be threaded to receive a threaded end portion of the fastener 310.

Figure 13:
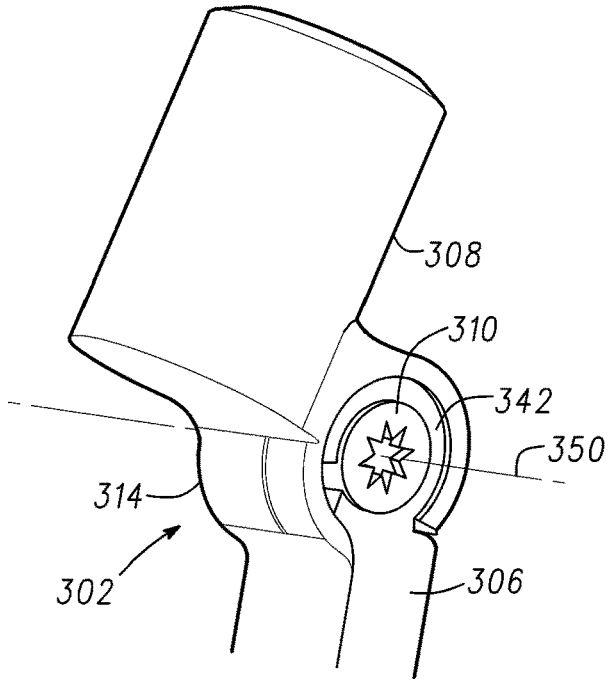
FIG. 13 shows a perspective view of the loft angle adjustment mechanism of the golf club head of FIG. 12.
Figure 17:
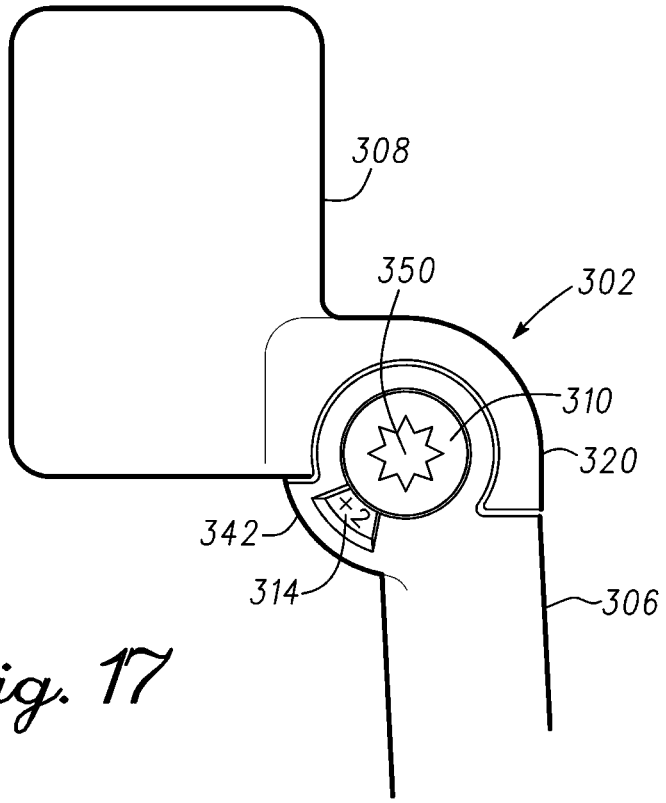
FIG. 17 shows a close-up of the loft angle adjustment mechanism of the golf club head of FIG. 12 showing a loft angle indicator.

Referring to FIGS. 13 and 17, the loft angle of the face 110 may be adjusted and/or changed by rotating the lower hosel portion 306 relative to the upper hosel portion 308 about the axis 350. When the lower hosel portion 306, the insert 330 and the upper hosel portion 308 are assembled as shown in FIGS. 12, 13 and 17 (the unassembled positions shown in FIGS. 14 and 15), the angular position of the lower hosel portion 306 relative to the upper hosel portion 308 is dependent upon the gap 333 that is aligned with the cutout 340. The radial length of each arm (i.e., the curved length around the insert 330) may be configured so as to position each gap 333 at a certain radial position around the insert 330 so that when the bridge portion 346 is received in the gap 333 that is aligned with the cutout 342, a certain loft angle for the face 110 is achieved. Accordingly, each gap 333 that is aligned with the cutout 340 positions the bridge portion 346 relative to the upper hosel portion 308 at a certain angle corresponding to the gap 333. Therefore, each gap 333 provides a certain angular position of the lower hosel portion 306 relative to the upper hosel portion 308 to provide a different loft angle for the face 110.

Figure 16:
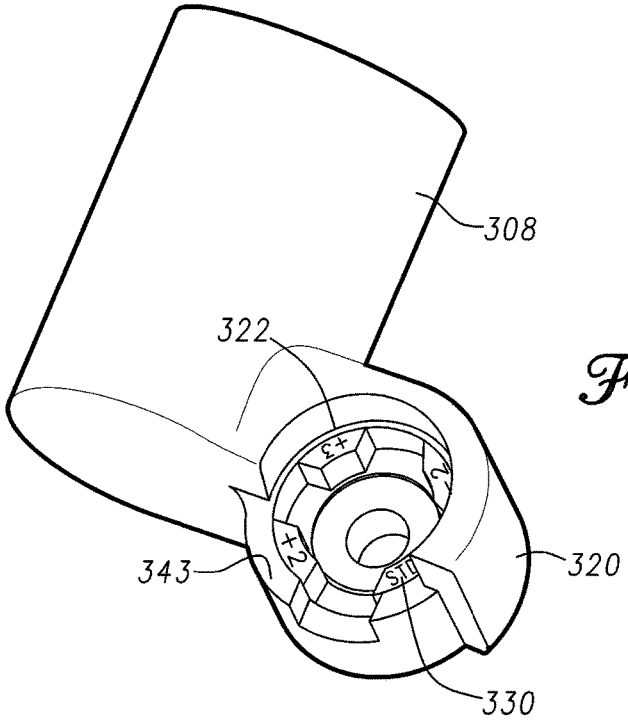
FIG. 16 shows a perspective view of a section of the loft angle adjustment mechanism of the golf club head of FIG. 12.

Referring to FIG. 16, when the arm 332 that indicates a standard loft angle, which is shown on top of the arm as "STD", is aligned with the position marker 343 such as to be visible through the window portion 348, the gap 333 that is aligned with the cutout 342 is radially oriented relative to the axis 350 such that when the bridge portion 346 is inserted in the gap 333, the loft angle of the face 110 is set to the neutral or standard loft angle. To change the loft angle from the standard loft angle, the fastener 310 can be removed so that the lower hosel portion 306, the insert 330 and the upper hosel portion 308 can be disassembled as shown in FIG. 14. The insert 330 can then be rotated so that the arm 332 that indicates a preferred loft angle is aligned with the position marker 343 so that the preferred loft angle can be viewed through the window portion 348 as shown in FIG. 17. The gap 333 corresponding to the preferred loft angle is then aligned with the cutout 342 so that the bridge portion 346 can be received therein. The gap 333 radially positions the bridge portion 346 relative to the axis 350 so that the loft angle of the face 110 is set to the adjusted or preferred loft angle, which is a loft angle shown through the window portion 348. The lower hosel portion 306, the insert 330 and the upper hosel portion 308 can then be reassembled and fastened with the fastener 310 as described herein.

In the examples of FIGS. 12-17, the arms 332 indicate a standard loft angle, a loft angle of +2°, a loft angle of −2°, and a loft angle of +3°. For example, if the neutral or standard loft angle corresponds to the face portion 110 having a loft angle of 3°, a loft angle setting of +2° corresponds to the face portion 110 having aloft angle of 5°. In the examples of FIGS. 12-17, four loft angle settings are provided with the insert 332. Accordingly, each of the four gaps 333 provides a different angular or radial position of the bridge portion 346 relative to the upper hosel portion 308. However, the number of arms 332 and the corresponding number of gaps 333 can be varied to provide more or less loft angle adjustments for the face portion 110. For example, six arms and six corresponding gaps may be provided for allowing an individual to adjust the loft angle of the golf club head at six different loft angle settings.

In the embodiments of FIGS. 12-17, the hosel 304 includes a first hosel portion 306 and a second hosel portion 308, which are rotatably coupled by the loft adjustment mechanism 302 to provide loft angle adjustment of the face portion 110. The loft adjustment mechanism 302 may be positioned at any location on the shaft, between the shaft (not shown) and the body portion 103, partially in the body portion 103 or fully in the body portion 103. For example, the first hosel portion 306 and the second hosel portion 308 may have generally the same length such that the loft adjustment mechanism 302 is located at approximately half the distance between the body portion 103 and the shaft (not shown). In another example, the loft adjustment mechanism 302 may be partially or fully located inside the body portion 103. Accordingly, the hosel 204 may be a one-piece hosel. Furthermore, the body portion 103 may include an insert receptacle (not shown) such as the insert receptacle 322, and a bore (not shown) extending through the insert receptacle to receive a fastener to attach an insert 330 in the insert receptacle of the body portion 103 as described in detail herein. The hosel 204 can then be mounted on and attached to the insert 230 as described in detail herein.

Referring to FIGS. 18-21, a golf club head 400 having an adjustable loft angle mechanism 402 according to one example is shown. The golf club head 400 may be similar in many respects to the golf club head 102. Accordingly, same parts may be referred to with the same reference numbers and the detailed description of the golf club head 400 is not provided for brevity. The golf club head 400 includes a body portion 103 and a hosel 404 that is configured to connect to a shaft (not shown). The hosel 404 may include a lower hosel portion 406 and an upper hosel portion 408. The upper hosel portion 408 is configured to receive a shaft (not shown). The hosel 404 is shown to be a one-piece hosel. Alternatively, the golf club head 400 may include a multi-piece hosel as described herein.

Figure 20:
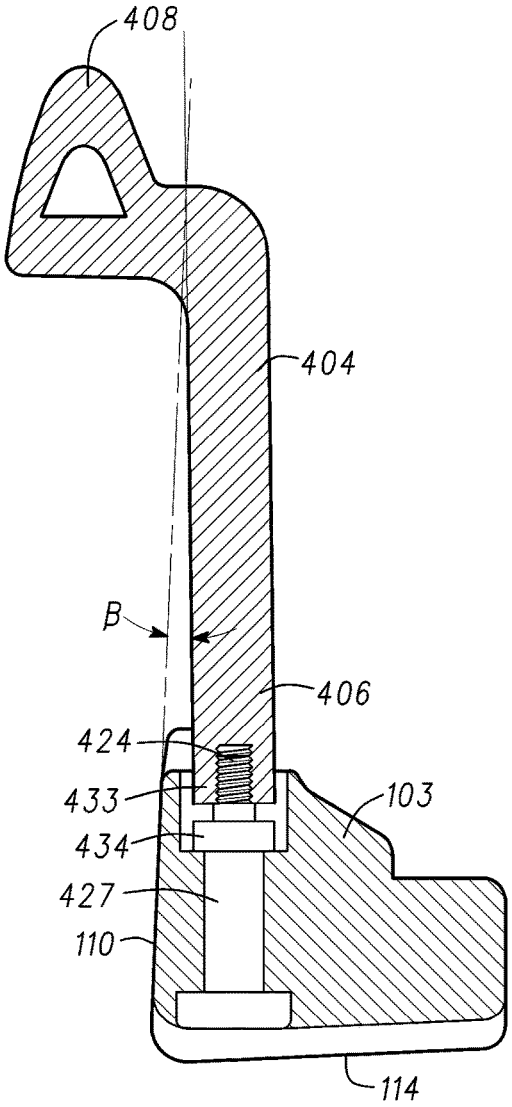
FIGS. 20 and 21 show the loft angle adjustment mechanism of FIG. 18 at two different loft angle settings.
Figure 21:
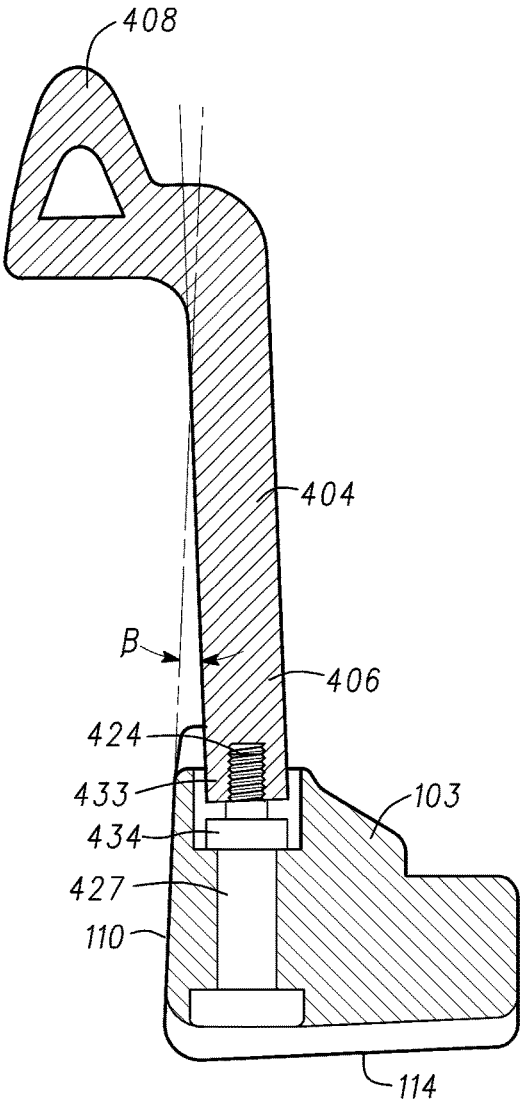

The upper hosel portion 408 is generally cylindrical to include a cylindrical hole 409 for receiving a shaft (not shown). Referring to FIGS. 20 and 21, the lower hosel portion 406 includes a bore 424 for receiving a fastener. The bore 424 may be threaded to receive a threaded fastener as described herein. The body portion 103 includes a recess 425 in the top rail portion 116 that is configured similar to an insert 430 to receive the insert 430 therein. A bore 427 extends from the bottom of the recess 425 through the body portion 103 and opens at the bottom of the body portion 103 (i.e., the sole portion 114 of the golf club head 400).

Figure 18:
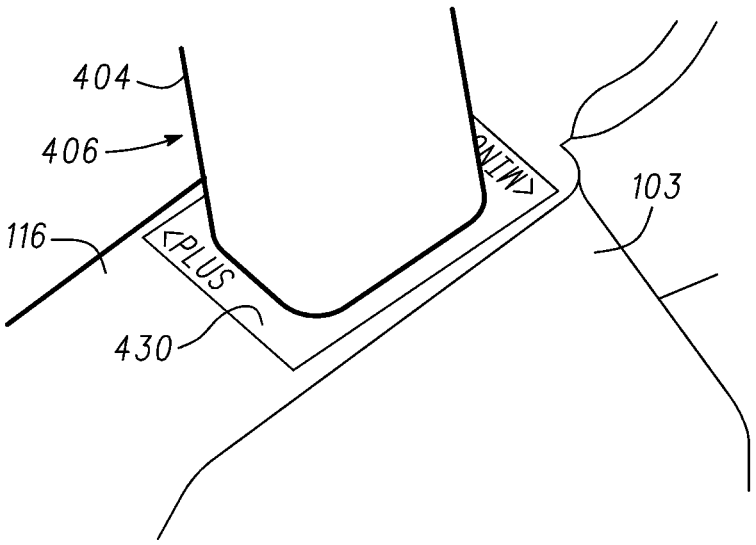
FIG. 18 shows a perspective view of a loft angle adjustment mechanism according to one embodiment.
Figure 19:
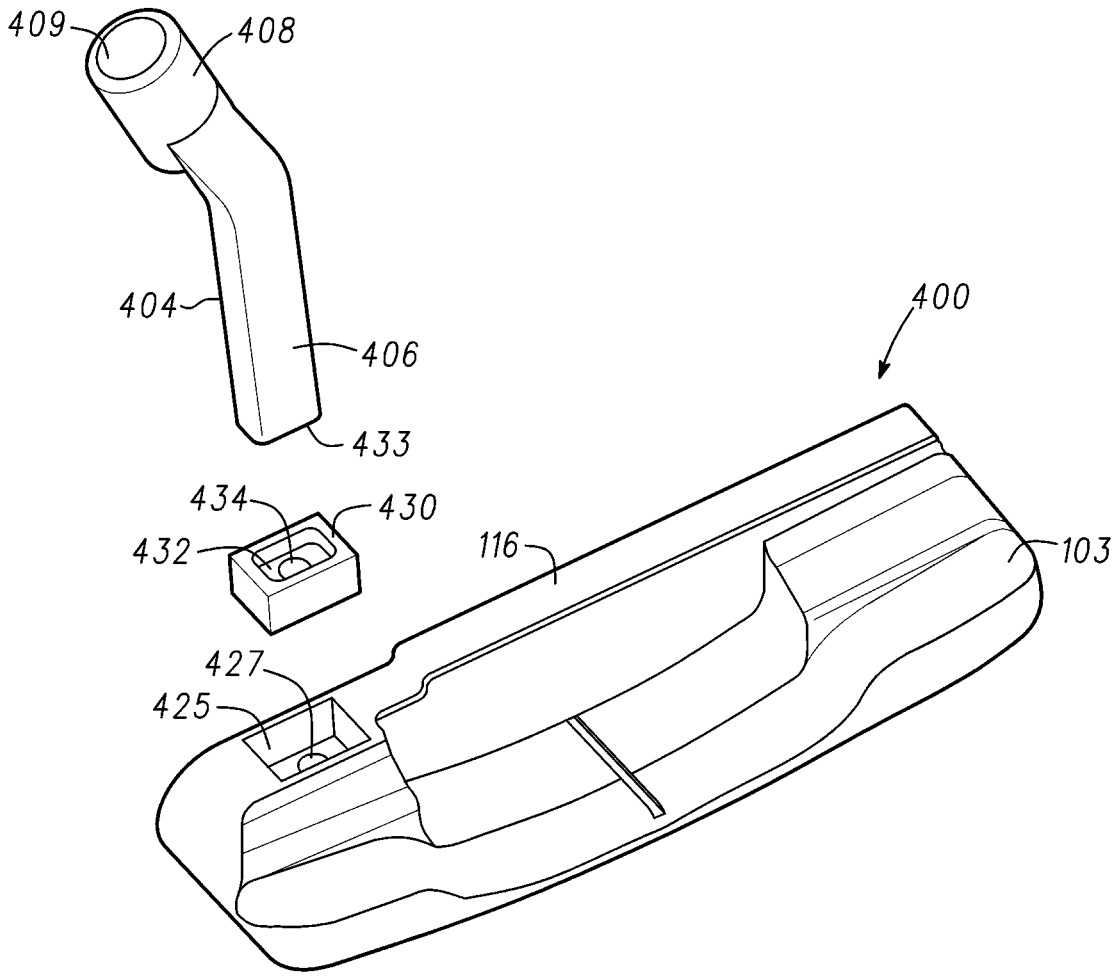
FIG. 19 shows an exploded perspective view of the loft angle adjustment mechanism of FIG. 18.

The insert 430 of the example of FIGS. 18-21 is rectangular. However, the insert 430 can be any shape as described in detail herein. Accordingly, the recess 425 is also rectangular and sized (i.e., length, width and depth) to receive the insert 430 therein. The insert 430 includes an insert recess 432 for receiving an end portion 433 of the lower hosel portion 406 therein. Thus, as shown in FIG. 18, the insert 430 can be inserted in the recess 425 and then the end portion 433 of the lower hosel portion 406 can be inserted in the insert recess 432. The insert 430 includes a bore 434 extending from the bottom of the insert recess 432 and through the insert 430. When the insert 430 is inserted in the recess 425 and the end portion 433 of the lower hosel portion 406 is inserted in the insert recess 432, the bores 424, 427 and 434 are aligned to receive a fastener (not shown) from the sole portion 114 of the golf club head 400. As shown in FIGS. 20 and 21, a fastener (not shown) may be inserted into the bore 427 from the sole portion 114 to extend through the bore 434 of the insert 430 and through the bore 427 of the lower hosel portion 406. The bore 427 of the lower hosel portion 406 may be threaded and the fastener may be a threaded fastener to engage the threads in the bore 427. Accordingly, the fastener can securely attach the hosel 404 to the insert 430 and the body portion 103 as shown in FIG. 18.

Figure 22:
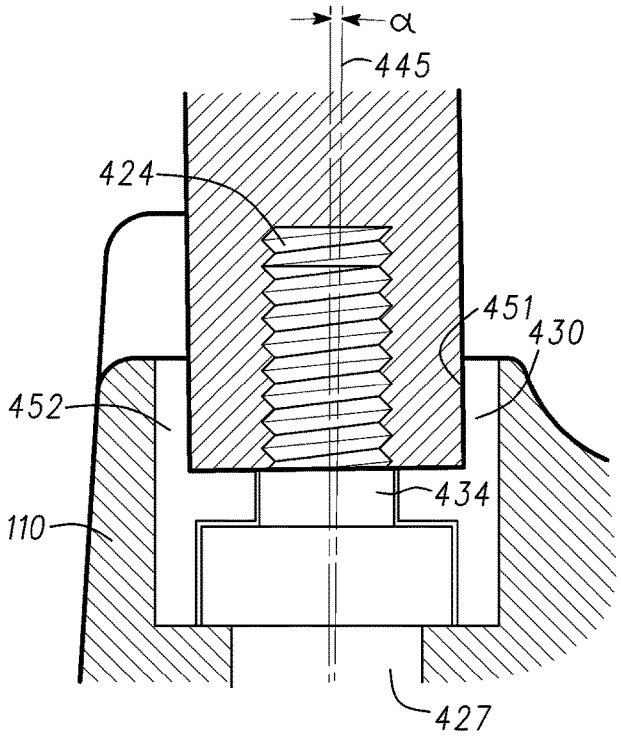
FIGS. 22 and 23 show close up views of portions of FIGS. 20 and 21, respectively.
Figure 23:
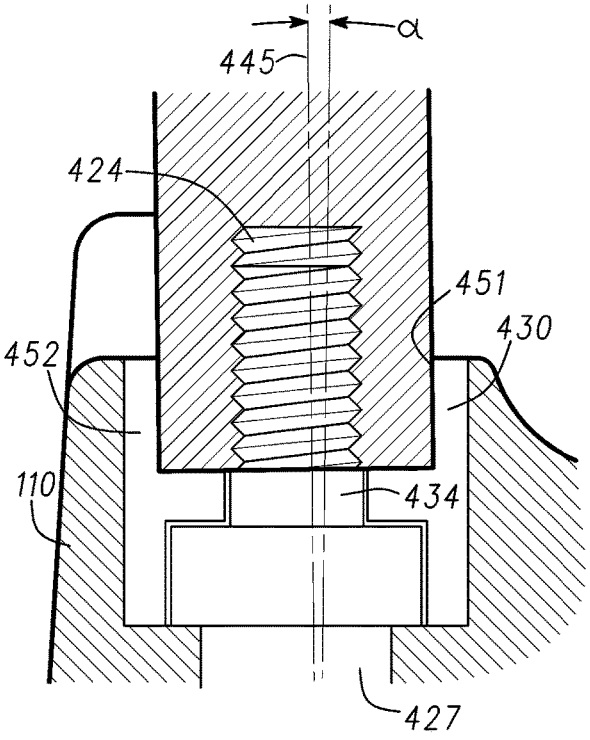

Referring also to FIGS. 22 and 23, the axis 445 of the bore 434 and the inner sidewalls 451 of the insert 430 form an angle $\alpha$ relative to the outer sidewalls 452 of the insert 430. Thus the insert recess 432 including the bore 434 is tilted by the angle $\alpha$ relative to the outer sidewalls 452 of the insert 430, and hence tilted by the angle $\alpha$ relative to the face portion 110. When the end portion 433 of the lower hosel portion 406 is fastened inside the insert recess 432, the end portion 433 of the lower hosel portion 406 is also tilted by the angle $\alpha$ relative to the face portion 110. In a first loft position of the insert 430 inside the recess 425 as shown in FIG. 22, the bore 434 is tilted by the angle $\alpha$ relative to the outer sidewalls 452 of the insert 430 in a direction toward the face portion 110. In a second loft position of the insert 430 inside the recess 425 as shown in FIG. 23, which entails a 180° rotation of the insert 430 relative to the first loft position, the bore 434 is tilted by the angle $\alpha$ relative to the outer sidewalls 452 of the insert 430 in a direction away the face portion 110.

The face portion 110 may have a standard or neutral loft angle of $\beta$ as shown in FIGS. 21 and 22. When the insert 430 is in the first loft position, the actual loft angle of the face portion 110, or the loft angle experienced by an individual using the golf club is $\beta-\alpha$. When the insert 430 is in the second loft position, the actual loft angle of the face portion 110, or the loft angle experienced by an individual using the golf club is $\beta+\alpha$. For example, if the face portion 110 has a standard or neutral loft angle of 3° and the angle $\alpha$ is 1°, the loft angle of the face portion can be set to 2° and 4° by placing the insert 430 in the first loft position and the second loft position, respectively. In another example, if the face portion 110 has a standard or neutral loft angle of 2° and the angle $\alpha$ is 1°, the loft angle of the face portion can be set to 1° and 3° by placing the insert 430 in the first loft position and the second loft position, respectively.

Referring to FIG. 18, the insert 430 may include one or more indicators to allow an individual to determine how to increase or decrease the loft angle of the golf club head, i.e., the face portion 110, by rotating the insert 430. In the example of FIG. 18, the insert 430 includes a "Minus" indicator with a corresponding arrow and a "Plus" indicator with a corresponding arrow. Rotating the insert 430 in the direction indicated by the arrow corresponding to the "Minus" indicator reduces the loft angle of the golf club head as discussed herein. Rotating the insert 430 in the direction indicated by the arrow corresponding to the "Plus" indicator increases the loft angle of the golf club head as discussed herein. The indicators may be text, numbers, symbols, images or any type of visual data that can convey to an individual information about adjusting the loft angle of the face portion 110.

The hosel 404 can be removed from the body portion 103 to adjust the loft angle of the golf club head, i.e., the face portion 110. Accordingly, an individual can change the hosel 404 and use different hosel styles to adjust for the arc in the motion of the putter when being used by the individual.

Referring to FIG. 18, the fitting of the insert 430 in the recess 425 and the fitting of the end portion 433 of the hosel 404 in the recess 432 of the insert 430 provides a near seamless or near gapless configuration for a golf club. Lack of seams or gaps provides a more aesthetically pleasing putter. Furthermore, the lack of seams or gaps provides a more precise and robust putter. The combination of loft adjustability and hosel adjustability allows a putter to be adjusted to fit different swing motions as wells compensate for different conditions of the playing surface. Making loft adjustable allows players to change the behavior of the putter according to the playing conditions. For example, loft can be increased when greens are slow to increase travel of the ball, and loft can be decreased when greens are fast to decrease ball travel.

Referring to FIG. 24, the loft angle adjustment mechanism 402 may be used as a lie angle adjustment mechanism. The axis 445 of the bore 434 and the inner sidewalls 453 of the insert 430 may form an angle $\gamma$ relative to the outer sidewalls 455 of the insert 430. Thus the insert recess 432 including the bore 434 may be tilted by the angle $\gamma$ relative to the outer sidewalls 455 of the insert 430, and hence tilted by the angle $\gamma$ relative to the body portion 103. The angles $\alpha$ of the loft adjustment mechanism as discussed above and the angle $\gamma$ of the lie adjustment mechanism may be in perpendicular planes. When the end portion 433 of the lower hosel portion 406 is fastened inside the insert recess 432, the end portion 433 of the lower hosel portion 406 is also tilted by the angle $\gamma$ relative to the body portion 103. In a first lie position (not shown) of the insert 430 inside the recess 425, the bore 434 is tilted by the angle γ relative to the outer sidewalls 455 of the insert 430 in a direction toward the heel portion of the golf club head. In a second lie position (not shown) of the insert 430 inside the recess 425, which entails a 180° rotation of the insert 430 relative to the first lie position, the bore 434 is tilted by the angle γ relative to the outer sidewalls 455 of the insert 430 in a direction toward the toe portion of the golf club head. Thus, the angle γ is added or subtracted from the standard or neutral lie angle of the golf club to provide two different lie angle adjustments.

The insert 430 of the example described herein is rectangular. Accordingly, the insert 430 provides two loft or lie adjustment positions. However, the insert 430 may be other geometric shapes to provide additional loft angle or lie angle adjustments. For example, a square insert 430 that fits inside a corresponding square recess 425 of the body portion 103 may provide 2-4 loft angle or lie angle adjustments. Each 90° rotation of the insert 430 and placement in the recess 425 may provide a different loft angle or a different lie angle. A hexagonal insert 430 that fits inside a corresponding hexagonal recess 425 of the body portion 103 may provide 4-6 loft angle or lie angle adjustments. Accordingly, each 60° rotation of the insert 430 and placement in the recess 425 may provide a different loft angle or a different lie angle. A circular insert 430 that first inside a corresponding circular recess 425 of the body portion 103 may provide a large number of loft or lie adjustments. Thus, the shape of the insert 430 and the corresponding recess 425 and the number of loft angle adjustments or lie angle adjustments provided is not limited to the example described herein. Furthermore, an insert 430 can provide both loft angle and lie angle adjustments with each rotation of the insert 430 in the recess of the body portion. For example, the axis 445 of the bore 434 and the inner sidewalls 451 and 453 of the insert 430 may be tilted by both an angle α and an angle γ. Accordingly, such an insert can simultaneously provide both loft angle and lie angle adjustments. According to another embodiment, an insert 430 may provide loft angle adjustments at certain rotational positions while providing lie angle adjustments at other rotational positions. For example, a square insert 430 can provide two loft angle adjustments positions and two lie angle adjustment positions. Each loft angle adjustment position of the insert 430 can be achieved from another loft angle adjustment position of the insert 430 by a rotation of 180°. Similarly, each lie angle adjustment position of the insert 430 can be achieved from another lie angle adjustment position of the insert 430 by a rotation of 180°. To move from a loft adjustment position to a lie adjustment position or vice versa, the insert can be rotated by 90°. Thus, an insert may be configured with a certain geometric shape, such as a polygon, to provide any combination of loft adjustments and/or lie adjustments.

Referring to FIG. 25, a method of manufacturing a golf club head according to one embodiment is shown. The method includes forming a body portion having a face portion (block 500), and forming a hosel portion configured to couple to a shaft (block 502). The method further includes forming a loft adjustment portion configured to couple the hosel portion and the body portion (block 504). The loft adjustment portion may be separate from the hosel portion and the body portion and is rotatable relative to the hosel portion and the body portion at a plurality of positions. Each of the plurality of positions may correspond to a different loft angle of the face portion. The loft adjustment portion may comprise any of the inserts 230, 330 or 430 described herein.

The hosel portion may be a single hosel portion, such as the hosel 404. Alternatively, the hosel portion may include a first hosel portion and a second hosel portion that are fixedly or rotatably connected together as described herein. The first hosel portion and the body portion may be formed together in one piece or as separate pieces that are attached together. The second hosel portion may be formed so as to couple to a shaft and to rotationally couple to the first hosel portion.

A golf club head according to the disclosure or any components there may be constructed from any type of material, such as stainless steel, aluminum, titanium, various other metals or metal alloys, composite materials, natural materials such as wood or stone or artificial materials such as plastic. A golf club head according to the disclosure or any components thereof may be constructed by stamping (i.e., punching using a machine press or a stamping press, blanking, embossing, bending, flanging, or coining, casting), injection molding, forging, machining or a combination thereof, or other processes used for manufacturing metal, composite, plastic or wood parts. For example, the body portion, a first hosel portion, the second hosel portion and/or any of the fasteners as described herein may be constructed in whole or in part from a metal or metal alloy such as aluminum, steel or titanium, while the insert 230 and/or the insert 330 may be constructed from plastic. The apparatus, methods, and articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. Further, any one or more embodiments or examples described herein may be used in partly or wholly in combination. The apparatus, methods, and articles of manufacture described herein are not limited in this regard.

Although certain example methods, apparatus, systems, and articles of manufacture have been described herein, the scope of coverage of this disclosure is not limited thereto. On the contrary, this disclosure covers all methods, apparatus, systems, and articles of manufacture fairly falling within the scope of the appended claims either literally or under the doctrine of equivalents.

What is claimed is:

1. A golf club head comprising:

a body portion having a face portion and a lower hosel portion, the lower hosel portion of the body portion having an end portion with a projection;

an upper hosel portion configured to couple to a shaft, the upper hosel portion comprising an insert receptacle having a projection; and an adjustment portion configured to couple the upper hosel portion and the body portion, the adjustment portion being separate from the upper hosel portion and the body portion and rotatable relative to the upper hosel portion and the body portion at a plurality of positions, each of the plurality of positions corresponding to one of a different loft angle or a different lie angle of the face portion, wherein the adjustment portion comprises:

an insert having:

an outer side having a plurality of radially spaced arms that extend outwardly from the outer side of the insert and a plurality of gaps located between the plurality of arms, wherein the projection of the lower hosel portion is configured to be received by the outer side of the insert;

an inner side opposite the outer side, the inner side comprising an indentation configured to receive the projection of the insert receptacle on the upper hosel portion;

wherein:

a fastener is inserted through the end portion of the lower hosel portion, through a hole in the insert, and through a hole in the insert receptacle of the upper hosel portion to secure the upper hosel portion, the insert, and the lower hosel portion together.

2. The golf club head of claim 1, wherein the upper hosel portion and the body portion are rotationally coupled about an axis transverse to a shaft axis when the shaft is coupled to the upper hosel portion.

3. The golf club head of claim 1, wherein the adjustment portion is rotatable about an axis transverse to a shaft axis when the shaft is coupled to the upper hosel portion.

4. The golf club head of claim 1, wherein the adjustment portion comprises an indicator configured to indicate one of the loft angle or the lie angle of the face portion.

5. The golf club head of claim 1, wherein an indication of the loft angle of the face portion is visible through an opening in at least one of the upper hosel portion or the body portion.

6. The golf club head of claim 1, wherein the plurality of radially spaced arms includes four radially spaced arms, the plurality of gaps includes four gaps, and the insert is configured to provide four loft angle settings of the club head.

7. The golf club head of claim 1, wherein the plurality of radially spaced arms includes six radially spaced arms, the plurality of gaps includes six gaps, and the insert is configured to provide six loft angle settings of the club head.

8. The golf club head of claim 1, wherein the insert is rotatable relative to the upper hosel portion and the body portion at four positions, each of the four positions corresponding to a different loft angle of the face portion.

9. The golf club head of claim 1, wherein the insert is rotatable relative to the upper hosel portion and the body portion at six positions, each of the six positions corresponding to a different loft angle of the face portion.

10. A method of manufacturing a golf club head comprising:

forming a body portion having a face portion and a lower hosel portion, the lower hosel portion of the body portion having an end portion with a projection;

forming an upper hosel portion configured to couple to a shaft, the upper hosel portion comprising an insert receptacle having a projection; and forming an adjustment portion configured to couple the upper hosel portion and the body portion, the adjustment portion being separate from the upper hosel portion and the body portion being rotatable relative to the upper hosel portion and the body portion at a plurality of positions, each of the plurality of positions corresponding to a different one of a loft angle or a lie angle of the face portion, wherein the adjustment portion comprises:

an insert having:

an outer side having a plurality of radially spaced arms that extend outwardly from the outer side of the insert and a plurality of gaps located between the plurality of arms, wherein the projection of the lower hosel portion is configured to be received by the outer side of the insert;

an inner side opposite the outer side, the inner side comprising an indentation configured to receive the projection of the insert receptacle on the upper hosel portion;

wherein:

a fastener is inserted through the end portion of the lower hosel portion, through a hole in the insert, and through a hole in the insert receptacle of the upper hosel portion to secure the upper hosel portion, the insert, and the lower hosel portion together.

11. The method of claim 10, comprising forming the upper hosel portion and the body portion such that the upper hosel portion and the body portion are rotationally coupled about an axis transverse to a shaft axis when the shaft is coupled to the upper hosel portion.

12. The method of claim 10, comprising forming the adjustment portion such that the loft adjustment portion is rotatable about an axis transverse to the shaft axis when a shaft is coupled to the upper hosel portion.

13. The method of claim 10, wherein the plurality of radially spaced arms includes four radially spaced arms, the plurality of gaps includes four gaps, and the insert is configured to provide four loft angle settings of the club head.

14. The method of claim 10, wherein the plurality of radially spaced arms includes six radially spaced arms, the plurality of gaps includes six gaps, and the insert is configured to provide six loft angle settings of the club head.

15. The method of claim 10, comprising forming the adjustment portion such that the adjustment portion comprises an indicator configured to indicate one of the loft angle or the lie angle of the face portion.

16. The method of claim 10, comprising forming at least one of the upper hosel portion or the body portion such that an indication of the loft angle of the face portion is visible through an opening in at least one of the upper hosel portion or the body portion.

17. The method of claim 10, wherein the insert is rotatable relative to the upper hosel portion and the body portion at four positions, each of the four positions corresponding to a different loft angle of the face portion.

18. The method of claim 10, wherein the insert is rotatable relative to the upper hosel portion and the body portion at six positions, each of the six positions corresponding to a different loft angle of the face portion.

* * * * *